US007901203B2

(12) United States Patent
Ni et al.

(10) Patent No.: US 7,901,203 B2
(45) Date of Patent: Mar. 8, 2011

(54) COMBUSTION CHAMBER

(75) Inventors: Alexander Ni, Baden (CH); Valter Bellucci, Fislisbach (CH); Peter Flohr, Turgi (CH); Bruno Schuermans, Basel (CH); Majed Toqan, Abu Dhabi (AE); Ken-Yves Haffner, Baden (CH)

(73) Assignee: ALSTOM Technology Ltd., Baden (CH)

( * ) Notice: Subject to any disclaimer, the term of this patent is extended or adjusted under 35 U.S.C. 154(b) by 909 days.

(21) Appl. No.: 11/676,584

(22) Filed: Feb. 20, 2007

(65) Prior Publication Data

US 2007/0224559 A1 Sep. 27, 2007

(30) Foreign Application Priority Data

Mar. 30, 2006 (DE) ..... 10 2006 015 230

(51) Int. Cl.
*F23N 1/02* (2006.01)

(52) U.S. Cl. ..... 431/12; 431/78; 431/79; 431/19; 431/114

(58) Field of Classification Search ..... 431/12, 431/78, 79, 19, 114
See application file for complete search history.

(56) References Cited

U.S. PATENT DOCUMENTS 4,913,647 A * 4/1990 Bonne et al. ..... 431/12
4,934,926 A * 6/1990 Yamazaki et al. ..... 431/75
5,249,954 A * 10/1993 Allen et al. ..... 431/14
5,487,266 A * 1/1996 Brown ..... 60/776
5,522,721 A * 6/1996 Drogue et al. ..... 431/1
5,544,478 A * 8/1996 Shu et al. ..... 60/773
5,706,643 A 1/1998 Snyder et al.
5,755,819 A * 5/1998 Bonanni et al. ..... 431/79
5,978,525 A * 11/1999 Shu et al. ..... 385/12
6,464,489 B1 * 10/2002 Gutmark et al. ..... 431/1
6,468,069 B2 * 10/2002 Lemelson et al. ..... 431/12
(Continued)

FOREIGN PATENT DOCUMENTS

DE 19928226 2/2001
(Continued)

OTHER PUBLICATIONS

Search Report for German Patent App. No. 10 2006 015 230.1 (Jan. 9, 2008).
(Continued)

*Primary Examiner* — Kenneth B Rinehart
*Assistant Examiner* — Daniel A Bernstein
(74) *Attorney, Agent, or Firm* — Cermak Nakajima LLP; Adam J. Cermak

(57) ABSTRACT

A combustion chamber (1), in particular in a gas turbine, has at least two burners (A-H) that are connected to a fuel supply (3) via controllable fuel valves (2' and 2). Each burner (A to H) is assigned at least one optical measuring device (4) for detecting chemiluminescent radiation, and the combustion chamber (1) is assigned a pressure sensor (7) for detecting a combustion chamber pressure. The optical measuring device (4) and the pressure sensor (7) are connected to a computing and control device, which calculates a correlation value from the incoming measured values. A high correlation value signifies that the associated burner is prone to pulsation. The computing and control device (6) is designed in such a way that it determines the burner or a burner group with the highest correlation and controls the associated fuel valve(s) in such a way that more fuel is fed to the respective burner or the respective burner group, and the pulsation tendency thereof is thereby reduced.

10 Claims, 1 Drawing Sheet

U.S. PATENT DOCUMENTS

| | | | | |
|---|---|---|---|---|
| 6,702,571 | B2 * | 3/2004 | Abbasi et al. | 431/187 |
| 6,742,341 | B2 | 6/2004 | Ryan et al. | |
| 7,334,413 | B2 * | 2/2008 | Myhre | 60/803 |
| 7,454,892 | B2 * | 11/2008 | Lieuwen et al. | 60/39.091 |
| 2005/0247064 | A1 * | 11/2005 | Lieuwen | 60/773 |
| 2006/0040225 | A1 * | 2/2006 | Garay et al. | 431/114 |
| 2006/0046218 | A1 * | 3/2006 | Joklik et al. | 431/75 |

FOREIGN PATENT DOCUMENTS

| | | |
|---|---|---|
| EP | 0918152 | 5/1999 |
| EP | 1621811 | 2/2006 |
| EP | 1764554 | 3/2007 |
| GB | 1162824 | 8/1969 |
| WO | WO2005010437 | 2/2005 |
| WO | WO2005093326 | 10/2005 |
| WO | WO2005093327 | 10/2005 |

OTHER PUBLICATIONS

Search Report for EP Patent App. No. 07101481.5 (Jul. 17, 2007).

* cited by examiner

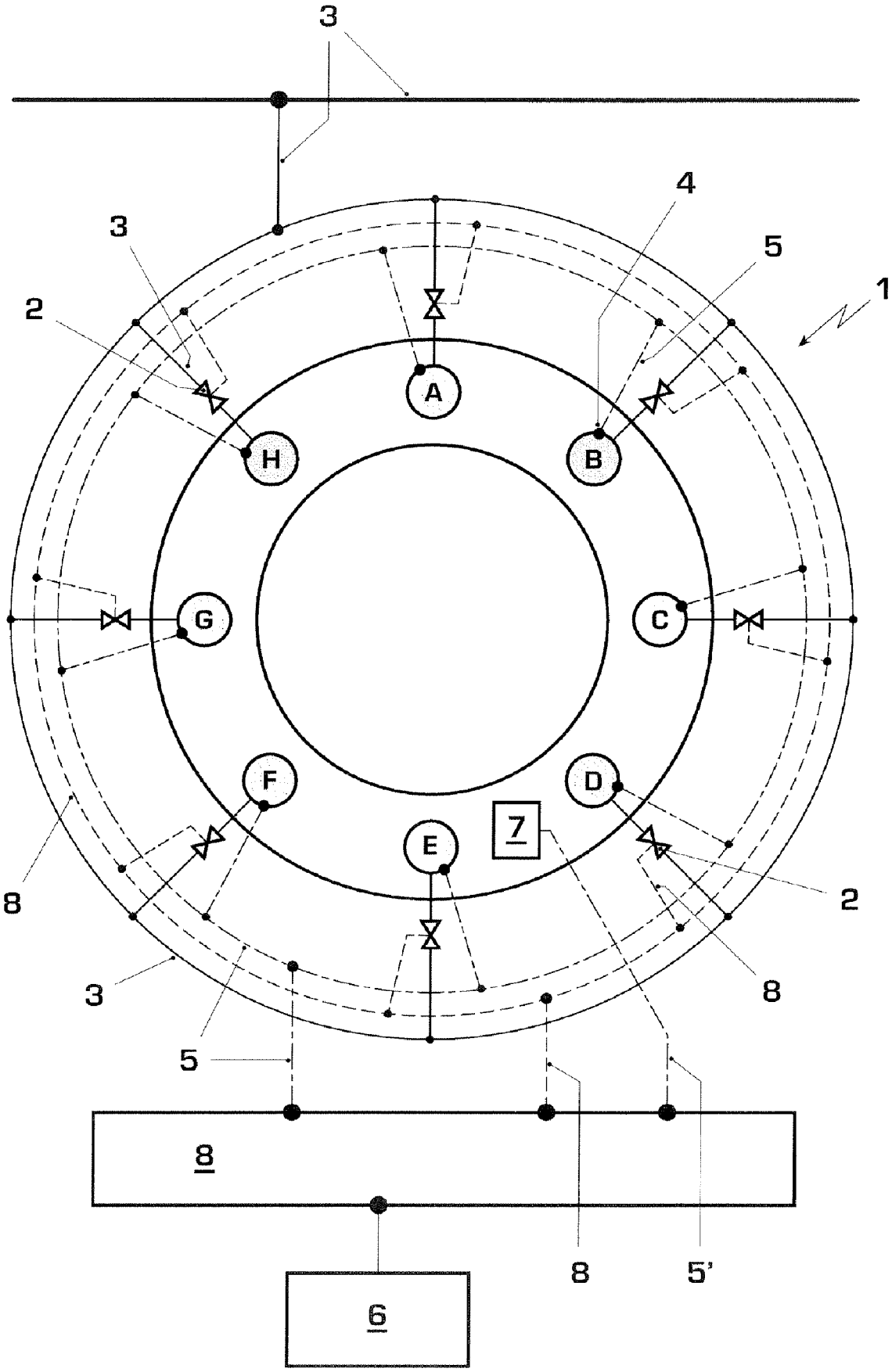
3
4
3
5
1
2
A
H
B
G
C
F
D
7
E
2
8
8
3
5
8
8
5'
6

COMBUSTION CHAMBER

This application claims priority under 35 U.S.C. § 119 to German application number 10 2006 015 230.1, filed 30 Mar. 2006, the entirety of which is incorporated by reference herein.

BACKGROUND

1. Field of the Invention

The invention relates to a combustion chamber, in particular to one in a gas turbine, having at least two burners that are connected to a fuel supply via controllable fuel valves.

2. Brief Description of the Related Art

Gas turbines are used, for example, for the generation of electrical energy in power plants, where they drive generators. Such turbines usually have a power of more than 50 MW and are designed, in particular, for stationary continuous operation. In order to be able to operate the gas turbine economically and with low pollutant emissions, in particular $NO_x$, the aim should be to operate it in a lean fashion, that is to say with as little fuel as possible, and, on the other hand, to avoid extinguishing the burner, since restarting the gas turbine is complicated and expensive.

However, this can give rise to a conflict of aims, since it is possible, particularly in the case of a lean operation of the gas turbine, for the flame in the combustion chamber to pulsate, and this leads to extinction of the same in the most unfavorable case. Pulsation of the flame depends in this case on various parameters such as, for example, an air volumetric flow and a fuel volumetric flow associated therewith, as well as on a fuel chamber temperature. Fundamentally, what is desired for the burners or the combustion chamber is a flame system that can be designated as stable, and in the case of which a quasi-stationary pulsation-free ignition zone is formed in the vicinity of the burner outlet that, apart from turbulence-induced stochastic positional fluctuations, burns at a fixed location even in the event of slight fluctuations in the entry flows.

For the purpose of being able to prevent pulsation of the flame in the combustion chamber, and thereby possible extinction of the flame, it is important to detect pulsation-prone burners as early as possible and to take appropriate countermeasures, since, as mentioned above, restarting the gas turbine because of an extinction of the flame is very complicated and expensive, and the economic efficiency of the gas turbine is negatively influenced thereby. Moreover, pulsating burners also diminish the efficiency of the gas turbine such that it should also be ensured with regard to a power yield that the quasi-stationary, pulsation-free ignition zone be formed in the region of the vicinity of the burner outlet.

SUMMARY

This is where principles of the invention come in. One of numerous aspect of the present invention is concerned with the problem in the case of a combustion chamber of a gas turbine of the aforementioned type mentioned, of detecting pulsation-prone burners as early as possible and, if appropriate, of taking suitable countermeasures such that a pulsation-free operation of the combustion chamber can be ensured.

Another aspect of the present invention involves the general idea of providing measuring devices that are suitable in the case of a combustion chamber, in particular of a combustion chamber of a gas turbine, with a number of burners and which determine burner-specific data from which a computing and control device can calculate correlation values that permit the burners to be divided into pulsation-prone and non-pulsation-prone burners. If the computing and control device specifies a burner as pulsation-prone on the basis of the values measured in the combustion chamber, more fuel is fed to this burner and the risk of pulsation is thereby reduced. The detection of the data of the combustion chamber for judging whether a burner is a critical one, that is to say prone to pulsation, is performed on the one hand via an optical measuring device that is assigned to each burner and is designed for detecting chemiluminescent radiation and, on the other hand, via a further measuring device in the form of a pressure sensor for detecting a combustion chamber pressure. The burners themselves are connected to a fuel supply via controllable fuel valves. In order to process the data incoming from the optical measuring devices and the pressure sensor, the computing and control device is connected to them on the input side. On the output side, the computing and control device is connected to the controllable fuel valves, and this enables at least the burners prone to pulsation to be controlled via a changed fuel feed. The computing and control device is designed, furthermore, in such a way that it calculates a correlation from the chemiluminescent radiation values and the pressures, and determines the burner or a burner group with the highest correlation. The associated fuel valve(s) of the burners thereby determined are thereupon opened by the computing and control device and the pulsation tendency of the burners is thereby reduced. The combustion chamber according to the invention can therefore be used for early detection of burners prone to pulsation, that is to say critical burners, and to take suitable countermeasures. This permits an overall lean operation of the combustion chamber and therefore low emission values, it being possible at the same time effectively to exclude an extinction of the flame in the combustion chamber. This firstly increases the efficiency, and secondly the cost effectiveness of the gas turbine equipped with the combustion chamber according to the invention.

It is expedient for the optical measuring devices and/or the pressure sensor and/or the fuel valves to be connected to the computing and control device in a communicating fashion via a BUS, such as a CAN BUS. Such CAN BUS systems enable a comprehensive data exchange and a corresponding communication between the different components that are connected and mutually networked. In particular, such CAN BUS systems create far reaching networking possibilities such that it is also conceivable to be able to connect further units for measuring, detecting or processing data, and to connect devices designed for controlling specific parameters.

In a preferred embodiment of the solution according to the invention, the optical measuring devices each have an optical fiber. This offers the advantage that the optical measuring device need not be arranged directly in the combustion chamber, but needs to be connected to the combustion chamber only via such an optical fiber. Moreover, the space requirement of such an optical fiber in the combustion chamber is minimal, for which reason it can also be installed at sites offering little space. Moreover, a sensor system of the optical measuring device is not exposed directly to the high temperatures prevailing in the combustion chamber, and this has a positive effect on the service life of the optical measuring devices.

Further important features and advantages of the invention follow from the drawing and from the associated description of the figures with the aid of the drawing.

BRIEF DESCRIPTION OF THE DRAWING

A preferred exemplary embodiment of the invention is illustrated in the drawing and explained in more detail in the following description.

The sole FIGURE shows a highly schematic illustration of a combustion chamber according to the invention with associated computing and control device.

DETAILED DESCRIPTION OF EXEMPLARY EMBODIMENTS

In accordance with the drawing FIGURE, a highly schematic combustion chamber 1, for example as used in a gas turbine, has a number of burners A to H that are connected via controllable fuel valves 2 to a fuel supply 3, for example a fuel line. The number of the burners A to H, here eight, is to be understood as purely exemplary, and so the invention is also intended to comprise a fuel chamber 1 with more than eight or less than eight, but at least two burners.

The burners A to H are arranged, for example, in an annular fashion and each have at least one optical measuring device 4 for detecting chemiluminescent radiation, in particular for detecting an OH chemiluminescence. The optical measuring devices 4 are connected to a computing and control device 6 via corresponding signal lines 5, in particular via a CAN bus 8. Moreover, the fuel valves 2, 2' can also be connected to the computing and control device 6 via corresponding control lines 5" via the CAN BUS 8. The optical measuring devices 4 detect light produced in the combustion chamber 1 because of chemical reactions, and, in accordance with a preferred embodiment, have an optical fiber. The optical fiber is responsible in this case for guiding light between the burner and the actual optical measuring device. Such an optical fiber can be, for example, a glass fiber that guides light signals from the burner to the optical measuring device 4. This offers the advantages that the optical measuring device 4 itself need not be arranged directly at the burner and is thereby exposed only to a substantially reduced temperature stress, and a requisite space requirement for the optical fiber is substantially less than for the optical measuring device 4, such that the latter can be arranged at virtually any desired site in the vicinity of the burner given little space on offer.

Furthermore, a pressure sensor 7 for detecting a pressure is arranged in the combustion chamber 1 and likewise connected to an input side of the computing and control device 6 via a corresponding signal line 5'. The pressure sensors can optionally also be connected to the computing and control device 6 via the CAN bus 8. According to the invention, the computing and control device 6 is now designed in such a way that it calculates a correlation between the chemiluminescent radiation of each burner A to H and the pressure in the combustion chamber 1 from the measured values incoming from the optical measuring devices 4 and the pressure sensor 7. On the output side, the computing and control device 6 is connected to the fuel valves 2 associated with each of the burners A to H.

Furthermore, the computing and control device 6 is designed in such a way that it determines the burner or a burner group with the highest correlation between chemiluminescent radiation and combustion chamber pressure, and controls the associated fuel valve(s) in such a way that more fuel is fed to the respective burner or the respective burner group. Thus, once the correlation between the incoming optical measured values and the incoming combustion chamber pressure reaches a specific limiting value, the computing and control device 6 opens the respectively associated fuel valve. A high correlation between the optical measured values and the combustion chamber pressure indicates, in this case, a pulsation tendency of the respective burner that is to be reduced in accordance with principles of the present invention. The pulsing of the flame firstly poses the risk of the latter's extinction, and there is secondly a reduction in the efficiency of the gas turbine. Pulsation-prone burners can therefore be identified by a high correlation between chemiluminescent radiation values and pressure values in the combustion chamber 1. It is conceivable here that the computing and control device 6 control only a single burner with the respectively highest correlation value by opening the associated fuel valve, or else an entire group of burners whose respective correlation values lie above a limiting value.

The combination to form a burner group can either comprise, for example, the burners A and B if these two have the two highest correlation values, or the burners can already be combined in advance to form specific groups, for example to form A, C, E and G such that the latter are controlled as a whole when only one of the said burners exceeds the correlation limiting value.

In order for the gas turbine not to overheat, when one or more fuel valves 2 are opened the others are proportionately throttled such that a substantially constant combustion chamber temperature or a substantially constant fuel flow can be maintained. In the case of a control operation by the computing and/or control device 6, more fuel is therefore fed to the pulsation-prone burners and, at the same time, less fuel is fed to the non-pulsation-prone burners. Here, as explained above, the computing and control device 6 can open the fuel valves only starting from a specific predefined correlation value, and so no control is exercised given a correlation for which there is no pulsation tendency yet. It goes without saying that the computing and control device 6 countercontrols the fuel valves of the non-pulsation-prone burners only if no pulsation occurs in their case.

The aim below is to provide a brief explanation of a method according to the invention for controlling a combustion operation in the above described gas turbine:

The measuring device 4 assigned respectively to a burner detects chemiluminescent radiation, for example an OH radical radiation, while a pressure sensor 7 simultaneously determines the pressure in the combustion chamber 1. The measured data determined in such a way are transmitted via lines 5, 5', for example via a CAN bus 8, to the computing and control device 6 which calculates a correlation therefrom. If the calculated correlation value exceeds a predefined correlation limiting value, the computing and control device 6 opens the associated fuel valve(s) and thereby reduces the risk of pulsation of the associated burner or the associated burner group. At the same time, the computing and control device 6 reduces the fuel feed to the other, non-pulsation-prone burners, that is to say those burners whose correlation value is below the correlation limiting value, such that a substantially constant combustion chamber temperature or a substantially constant fuel flow is preferably maintained. In general, the computing and control device 6 counter-controls the fuel valves of the non-pulsation-prone burners only if in the case of the latter no risk of pulsation or no pulsation occurs.

| List of Reference Numerals | |
|---|---|
| 1 | Combustion chamber |
| 2 | Fuel valve |
| 3 | Fuel supply/fuel line |
| 4 | Optical measuring device |
| 5 | Lead/control line/signal line |
| 6 | Computing and control device |
| 7 | Pressure sensor |
| 8 | CAN bus |
| A-H | Burners |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A combustion chamber comprising:

at least two burners and at least two controllable fuel valves, the at least two burners connectable to a fuel supply via the fuel valves;

at least one optical measuring device for detecting chemiluminescent radiation, for each of the at least two burners, each burner being assigned at least one optical measuring device;

a pressure sensor configured and arranged to detect a pressure in the combustion chamber;

a computing and control device connected to the optical measuring devices, to the pressure sensor, and to the at least two fuel valves;

wherein the computing and control device is configured and arranged to calculate, from measured values input by the optical measuring devices and the pressure sensor, a correlation between the chemiluminescent radiation of each of the at least two burners and the pressure in the combustion chamber; and wherein the computing and control device is further configured and arranged to determine the burner or a burner group with the highest correlation, and to control a fuel valve or fuel valves associated with said burner or burner group with the highest correlation, so that more fuel is fed to said burner or burner group with the highest correlation;

wherein the computing and control device is configured and arranged to maintain a substantially constant fuel chamber temperature or a substantially constant fuel flow by correspondingly controlling the fuel valve or valves of burner or burners not prone to pulsation in a proportionate manner counter to the fuel valve or valves of the burner or burners prone to pulsation.

2. The combustion chamber as claimed in claim 1, further comprising:

a bus communicatingly connecting the optical measuring devices, the pressure sensor, the fuel valves, or combinations thereof, to the computing and control device.

3. A combustion chamber as claimed in claim 2, wherein the BUS comprises CAN-BUS.

4. The combustion chamber as claimed in claim 1, wherein the optical measuring devices are configured and arranged to detect an OH chemiluminescence.

5. The combustion chamber as claimed in claim 1, wherein the optical measuring devices each have an optical fiber.

6. A gas turbine comprising the combustion chamber of claim 1.

7. A method for controlling a combustion operation involving at least two burners and a combustion chamber, the method comprising:

detecting, with an optical measuring device respectively assigned to each burner, chemiluminescent radiation, and simultaneously determining, with a pressure sensor, a pressure in the combustion chamber;

calculating with a computing and control device connected on an input side to the optical measuring devices and the pressure sensor, and on an output side to controllable fuel valves for said at least two burners, a correlation between the chemiluminescent radiation of each burner and the pressure in the combustion chamber from the measured values incoming from the optical measuring devices and from the pressure sensor;

determining, with the computing and control device, the burner or a burner group with the highest correlation;

opening one or more fuel valves associated with said burner or burner group with the highest correlation, based on said determining; and in order to maintain a substantially constant fuel chamber temperature or a substantially constant fuel flow, correspondingly controlling with the computing and the control device fuel valves of burners not prone to pulsation in a proportionate fashion counter to those of the burner or burners prone to pulsation.

8. The method as claimed in claim 7, wherein opening comprises opening, with the computing and control device, fuel valves only starting from a predefined correlation value.

9. The method as claimed in claim 7, further comprising:

countercontrolling, with the computing and control device, a fuel valve or fuel valves of burner or burners not prone to pulsation only to the extent that no pulsation occurs in them.

10. A method as claimed in claim 7, wherein the combustion operation is a combustion operation of a gas turbine.

* * * * *